US007614861B2

(12) United States Patent
Nagler

(10) Patent No.: US 7,614,861 B2
(45) Date of Patent: Nov. 10, 2009

(54) ROTARY FLUID-DRIVEN MOTOR WITH SEALING ELEMENTS

(75) Inventor: Ehud Nagler, Kiryat Tivon (IL)

(73) Assignee: Hydro-Industries Tynat Ltd., Roah Haavin (IL)

( * ) Notice: Subject to any disclaimer, the term of this patent is extended or adjusted under 35 U.S.C. 154(b) by 448 days.

(21) Appl. No.: 10/549,677

(22) PCT Filed: Aug. 17, 2005

(86) PCT No.: PCT/IL2005/000897

§ 371 (c)(1),
(2), (4) Date: Sep. 19, 2005

(87) PCT Pub. No.: WO2006/018848

PCT Pub. Date: Feb. 23, 2006

(65) Prior Publication Data

US 2007/0041859 A1 Feb. 22, 2007

(51) Int. Cl.
*F03C 2/00* (2006.01)
*F03C 4/00* (2006.01)
*F04C 15/00* (2006.01)

(52) U.S. Cl. ..... 418/146; 418/116; 418/140; 418/145; 418/152; 418/259

(58) Field of Classification Search ..... 418/104, 418/113, 116, 129, 136, 140, 143–148, 152, 418/259, 266–268
See application file for complete search history.

(56) References Cited

U.S. PATENT DOCUMENTS

| | | | | |
|---|---|---|---|---|
| 140,914 | A * | 7/1873 | Grotz | 418/146 |
| 674,837 | A * | 5/1901 | Gadberry | 418/146 |
| 3,465,683 | A * | 9/1969 | Blomgren | 418/152 |
| 5,100,308 | A * | 3/1992 | Gevelhoff et al. | 418/152 |

* cited by examiner

*Primary Examiner*—Theresa Trieu
(74) *Attorney, Agent, or Firm*—Mark M Friedman

(57) ABSTRACT

A static-fluid-pressure-driven rotary motor includes a casing, which defines a chamber having a fluid inlet and a fluid outlet, and at least one rotor assembly rotatably mounted within the casing. The rotor assembly includes a rotor, a plurality of barrier elements associated with, and extending outwards from, the rotor, and a resilient seal associated with at least an outer edge of each of the barrier elements. As the rotor turns about its axis of rotation, the outer edges of the barrier elements passing in proximity to a facing wall of the casing chamber against which the resilient seals for a sliding seal while accommodating variations in clearance between the outer edge of the barrier element and the facing wall of the casing.

21 Claims, 13 Drawing Sheets

ROTARY FLUID-DRIVEN MOTOR WITH SEALING ELEMENTS

FIELD AND BACKGROUND OF THE INVENTION

The present invention relates to rotary fluid-driven motors and, in particular, it concerns rotary water-driven or air-driven motors which employ sealing elements.

Rotary hydraulic motors are motors which are driven by static fluid pressure. In other words, they are designed geometrically such that the balance of surfaces acted upon by the inlet liquid pressure is always eccentric to the axis of rotation. The product of the balance of surfaces and the liquid pressure together with the eccentricity (the perpendicular distance of the balance of surfaces from the axis of rotation) generates a net moment in the direction of rotation.

Known types of hydraulic motor operating according to these principles include various types of vane motors and gear motors. Motors of these types tend to suffer from internal leakage from the high-pressure inlet region to the low-pressure outlet region. Leaks of this kind do not perform "work", i.e., they do not contribute to positive displacement of the parts of the motor, and they therefore reduce power efficiency of the motor. Accordingly, such leaks need to be minimized by internal sealing mechanisms within the motor.

The conventional approach to achieving effective sealing within rotary hydraulic motors is by use of high precision components with very small clearances between the moving parts and the motor casing. Since the flow rate of the leaks is a function of the size of the clearances between parts, the leakage rates can be reduced by employing very small clearances. Nevertheless, this approach tends to inherently allow some degree of leakage. Typically, the volumetric efficiency curve for motors of this type is poor at low power and rises asymptotically towards a maximum value at higher flow rates (see FIG. 1). Since most oil-based hydraulic systems are high-power systems employing operating pressures of at least tens, if not hundreds, of atmospheres, the energy losses from leakage are typically not particularly problematic.

In the field of domestic and garden automation, there is a trend towards devices which are powered by water-driven or air-driven motors actuated by connection to a domestic water supply or a supply of compressed air. In order for such devices to be lightweight, cost effective and to avoid corrosion, it would be advantageous to produce water-driven motors primarily or exclusively from injection molded plastic components. This however presents problems due to the relatively wide manufacturing tolerances which must be allowed for due to the current limitations of plastic injection molding technology. This problem is further exacerbated by the low pressure fluid supply, typically in the range of 2-8 atmospheres in the case of a domestic water supply. This combination of low driving pressure and wide manufacturing tolerances renders the implementation of static-fluid-pressure-driven motors for low-cost domestic applications particularly problematic.

As an alternative to static-fluid-pressure driven motors, many existing water-driven devices employ turbine-type motors where a rotor is driven by kinetic energy transferred from a flow of water impinging upon the rotor blades. Such a device is necessarily not sealed, and therefore does not require high precision manufacturing techniques. Turbine-type devices, however, offer very low efficiency and are particularly problematic at low flow rates.

There is therefore a need for rotary hydraulic motors produced primarily from injection-molded plastic components which would offer effective sealing under domestic water-actuated or air-pressure-actuated operating conditions.

SUMMARY OF THE INVENTION

The present invention is

According to the teachings of the present invention there is provided, a static-fluid-pressure-driven rotary motor for converting fluid pressure at an inlet into a mechanical rotary output, the motor comprising: (a) a casing defining a chamber having a fluid inlet and a fluid outlet; and (b) at least one rotor assembly rotatably mounted within the casing, the rotor assembly including: (i) a rotor mounted so as to be rotatable about an axis of rotation; (ii) a plurality of barrier elements associated with, and extending outwards from, the rotor, each of the barrier elements having an outer edge configured for passing in proximity to a facing wall of the casing chamber; and (iii) a resilient seal associated with at least the outer edge of each of the barrier elements, the resilient seal being configured to form a sliding seal between the outer edge and the facing wall while accommodating variations in clearance between the outer edge and the facing wall.

According to a first set of embodiments, the motor of the present invention is implemented as a gear motor, wherein the at least one rotor assembly is implemented as a pair of the rotor assemblies, and wherein the barrier elements are implemented as gear teeth, the pair of rotor assemblies being mounted with the axes of rotation parallel such that the gear teeth intermesh.

According to an alternative set of embodiments, the motor of the present invention is implemented as a vane motor, wherein the at least one rotor assembly is mounted with the axis of rotation eccentrically located with respect to the casing, and wherein each of the barrier elements is implemented as a vane radially displaceable relative to the axis of rotation.

According to a further feature of the present invention, the vanes are radially displaceable within slots formed in the rotor, the rotor assembly further including at least one resilient vane-slot seal deployed to form a sliding seal between each of the vanes and facing surfaces of a corresponding one of the slots.

According to a further feature of the present invention, the casing is formed with a guide track and wherein each of the vanes is provided with track-engaging features for engagement with the guide track, the guide track being deployed so as to maintain a predefined spacing between each of the vanes and the facing wall of the housing during rotation of the rotor assembly.

According to a further feature of the present invention, the guide track is implemented as a channel formed in an axial end wall of the casing, and wherein the track-engaging features are implemented as a slider block projecting axially from each of the vanes for sliding engagement within the guide channel.

According to a further feature of the present invention, the resilient seal includes an elastomeric seal element deployed so as to contact the facing wall of the housing during operation of the motor.

According to a further feature of the present invention, the outer edge of each of the barrier elements includes an outward facing slot, and wherein each of the elastomeric seal elements is deployed at least partially within a corresponding one of the outward facing slots.

According to a further feature of the present invention, the elastomeric seal element is formed with a substantially circular cross-sectional shape.

According to a further feature of the present invention, the elastomeric seal element is formed with a pair of diverging tapered blades for sliding against the facing wall of the casing.

According to a further feature of the present invention, the resilient seal is a pressure-responsive seal configured such that a fluid pressure differential applied between opposite sides of the barrier enhances a sealing effect of the seal.

According to a further feature of the present invention, the resilient seal includes a substantially rigid contact element deployed so as to contact the facing wall of the housing during operation of the motor, the substantially rigid contact element being resiliently mounted relative to the corresponding one of the barrier elements.

According to a further feature of the present invention, the contact element is supported by a spring deployed so as to bias the contact element towards the facing wall of the casing.

According to a further feature of the present invention, the contact element is supported by elastomeric material deployed so as to bias the contact element towards the facing wall of the casing.

According to a further feature of the present invention, the contact element is integrally formed with the barrier element, the contact element being interconnected with the barrier element through an integral hinge.

According to a further feature of the present invention, each of the barrier elements has upper and lower edges, and wherein the rotor assembly further includes upper and lower seal elements associated with the upper and lower edges and forming a sliding seal between the barrier elements and upper and lower surfaces, respectively, of the chamber.

According to a further feature of the present invention, the upper and lower seal elements are contiguous with the resilient seals.

According to a further feature of the present invention, the upper and lower seal elements extend substantially radially relative to the axis of rotation.

According to a further feature of the present invention, the rotor assembly further includes a rotor seal arrangement substantially circumscribing the axis of rotation and deployed for sealing between ends of the rotor and upper and lower surfaces of the chamber.

According to a further feature of the present invention, there is also provided a floating seal plate overlying an end of the rotor assembly and biased against the rotor assembly by at least one biasing arrangement such that the floating seal plate seals against the rotor assembly.

According to a further feature of the present invention, there is also provided a connector configuration associated with the fluid inlet of the motor and adapted for interconnection with a standard domestic water supply connector.

According to a further feature of the present invention, the casing is formed primarily from plastic material.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a rotary water-pressure-driven or air-pressure-driven motor with supplementary sealing elements.

The principles and operation of motors according to the present invention may be better understood with reference to the drawings and the accompanying description.

By way of introduction, the present invention addresses the aforementioned problems of implementing rotary water-driven or air-driven motors using injection-molded plastic components and/or driven by relatively low input fluid pressures such as less than 10 atmospheres where the manufacturing tolerances between the moving elements and the motor casing are accommodated by resilient seals. The seals are contact seals (as opposed to the non-contact clearance seals of most hydraulic motors) and may be implemented using various elastomeric seals, rigid seals with resilient biasing elements, or combinations thereof. The use of resilient sealing elements makes it possible to use the principles of rotary hydraulic motors without requiring high precision manufacture of the components since the sealing elements themselves accommodate the range of clearances between components. Most preferably, the present invention employs a "positive seal" or "pressure responsive seal", terms used herein to refer to a seal where application of a pressure differential across the seal acts to enhance the effectiveness of the seal.

Figure 1:
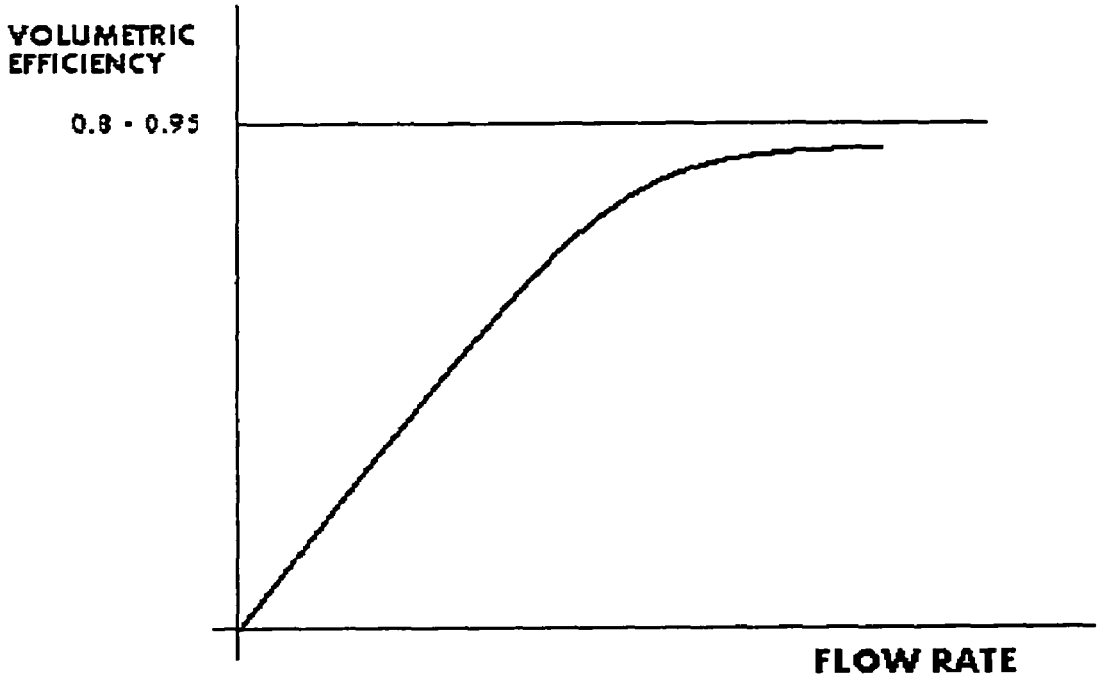
FIG. 1 (PRIOR ART)
FIG. 1 is a graph showing the volumetric efficiency of conventional rotary hydraulic motors as a function of flow rate.
Figure 2:
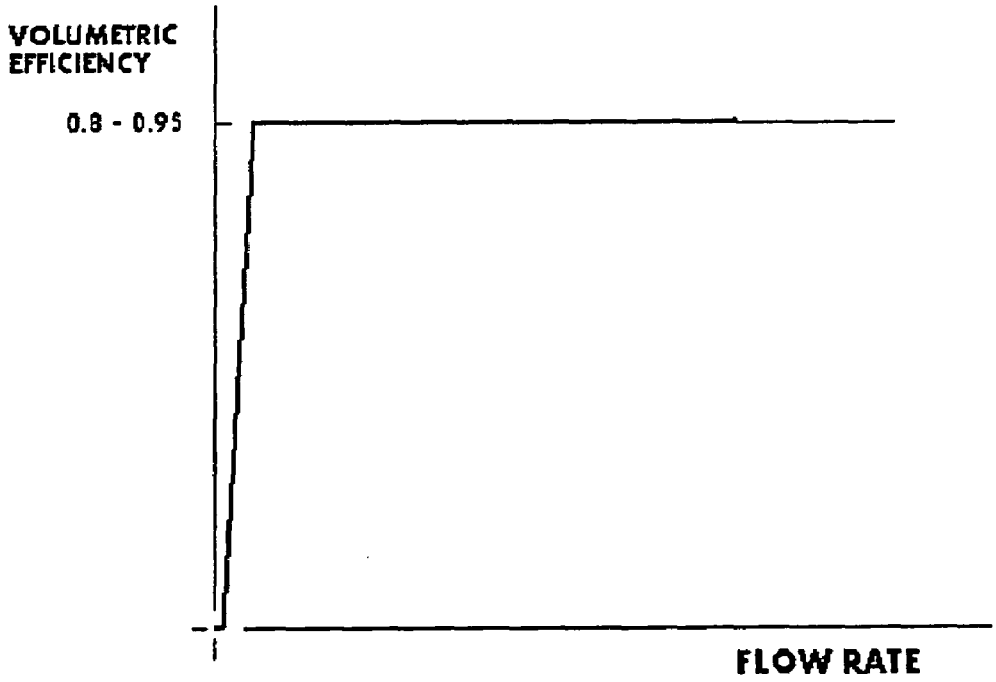
FIG. 2 is a graph showing the volumetric efficiency of a rotary hydraulic motor, constructed and operative according to the teachings of the present invention, as a function of flow rate.

The use of contact sealing elements in a rotary hydraulic motor also leads to a fundamental change in the volumetric efficiency of the motor such that the asymptotic graph of FIG. 1 changes to approximate to a step function as shown in FIG. 2. This is because, in contrast to the clearance seals of the prior art, the contact seals of the present invention provide effective leak resistance even at very low flow rates.

Thus, in general terms, the present invention provides a static-fluid-pressure-driven rotary motor for converting fluid pressure at an inlet into a mechanical rotary output. The motor includes a casing, which defines a chamber having a fluid inlet and a fluid outlet, and at least one rotor assembly rotatably mounted within the casing. The rotor assembly includes a rotor, a plurality of barrier elements associated with, and extending outwards from, the rotor, and a resilient seal associated with at least an outer edge of each of the barrier elements. As the rotor turns about its axis of rotation, the outer edges of the barrier elements passing in proximity to a facing wall of the casing chamber against which the resilient seals for a sliding seal while accommodating variations in clearance between the outer edge of the barrier element and the facing wall of the casing.

This common inventive concept is described herein with reference to the drawings in the context of two particularly preferred embodiments. A first embodiment, described with reference to FIGS. 3A-5D, is a vane motor, wherein the at least one rotor assembly 10 is mounted with the axis of rotation eccentrically located with respect to the casing 12, 12', and wherein each of the barrier elements is implemented as a vane 14 radially displaceable relative to the axis of rotation. A second embodiment, described with reference to FIGS. 6A-6D, is a gear motor in which the at least one rotor assembly is implemented as a pair of rotor assemblies 16, 18 in a correspondingly shaped chamber of a casing 20, 20', and the barrier elements are intermeshing gear teeth 22. In both embodiments, at least the outer edge of each barrier element (vane 14 or gear tooth 22) are provided with a resilient seal 24 which forms a sliding seal between the barrier element and the complementary facing wall of the chamber of the casing 12 or 20. Various preferred options for implementing the seals 24 and other features of the invention generic to all embodiments will then be described with reference to FIGS. 7-12.

Figure 3A:
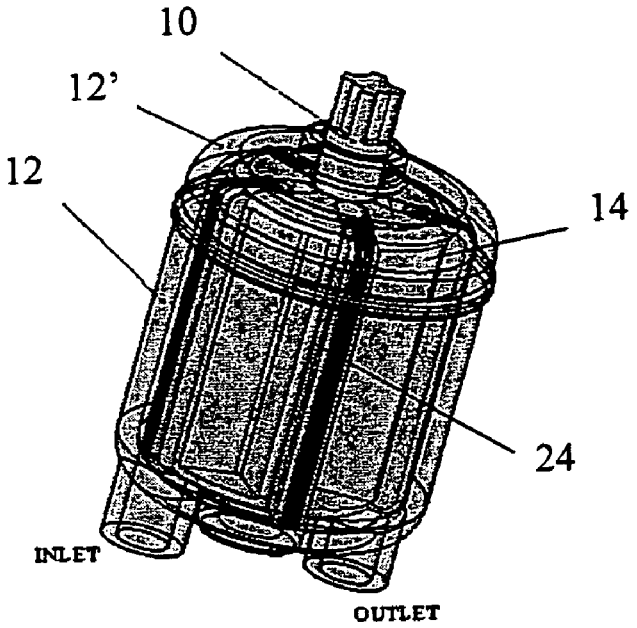
FIG. 3A is a partially transparent isometric view of a vane motor, constructed and operative according to the teachings of the present invention.
Figure 3B:
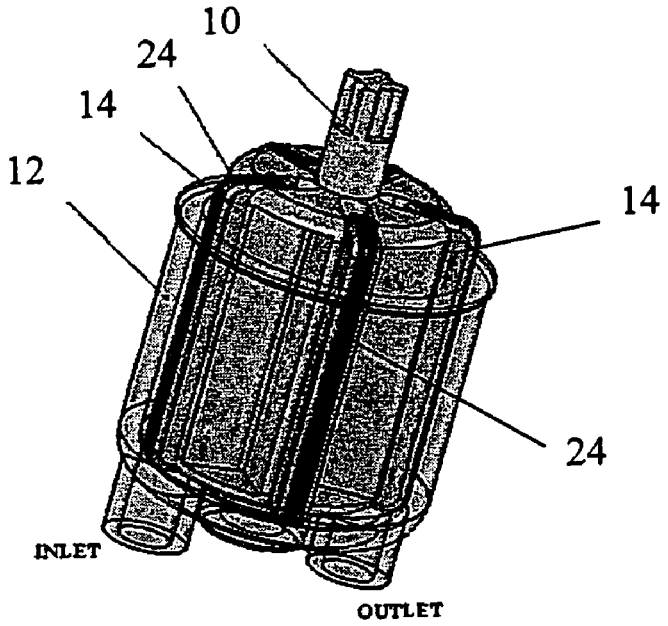
FIG. 3B is an isometric view of the vane motor of FIG. 3A with a cover portion of a casing removed.
Figure 3C:
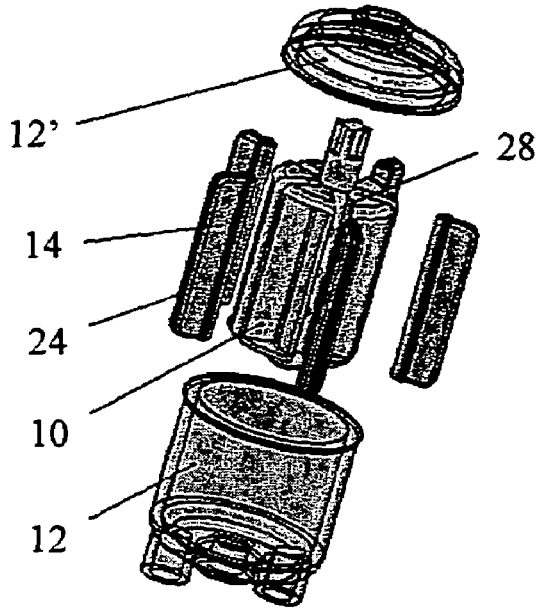
FIG. 3C is an exploded isometric view of the vane motor of FIG. 3A.
Figure 3D:
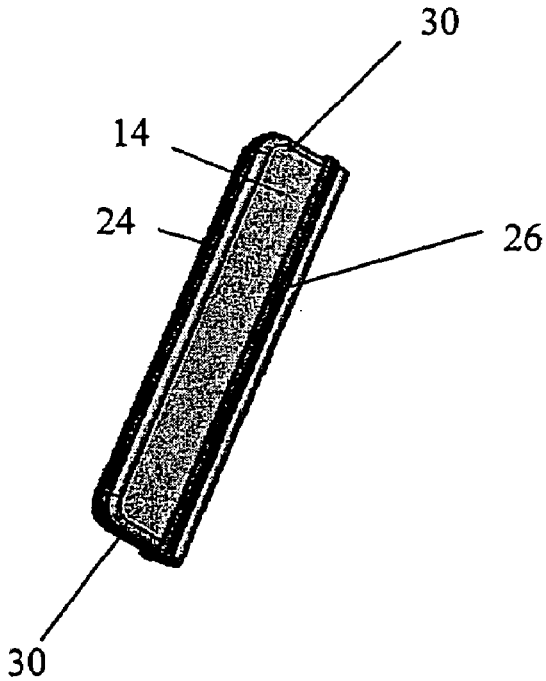
FIG. 3D is an isometric view of a vane element from the vane motor of FIG. 3A.
Figure 4A:
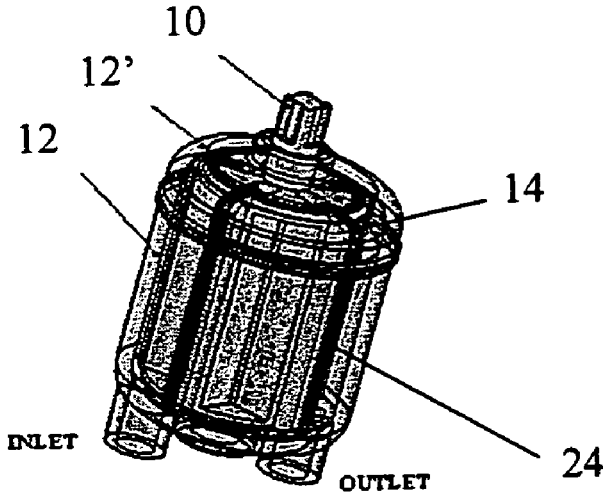
FIG. 4A is a partially transparent isometric view of a first variant implementation of a vane motor, constructed and operative according to the teachings of the present invention.
Figure 4B:
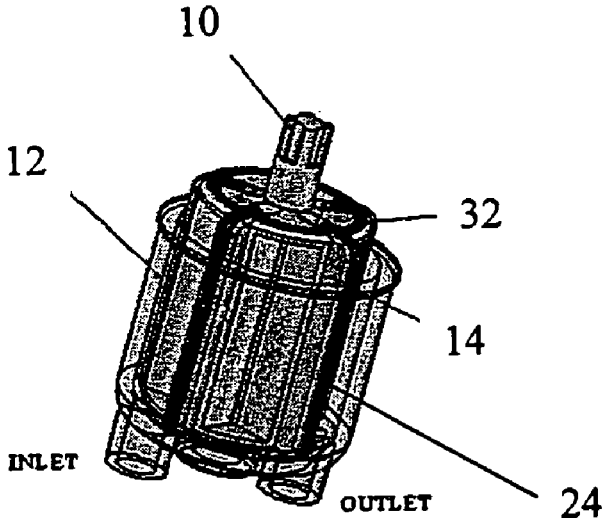
FIG. 4B is an isometric view of the vane motor of FIG. 4A with a cover portion of a casing removed.
Figure 4C:
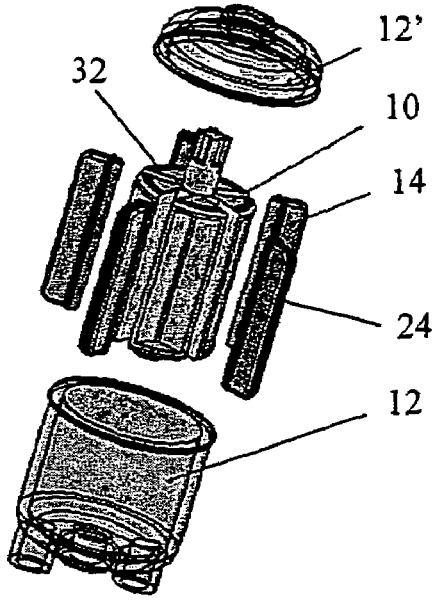
FIG. 4C is an exploded isometric view of the vane motor of FIG. 4A.
Figure 4D:
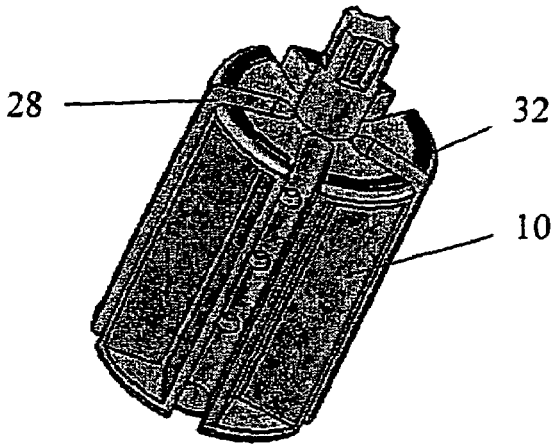
FIG. 4D is an isometric view of a rotor from the vane motor of FIG. 4A with the vanes removed.

Turning now specifically to the vane motor implementation of FIGS. 3A-3D, these illustrate a first implementation of the vane motor embodiment of the present invention. As in a conventional vane motor, the motor includes a rotor 10 mounted eccentrically within a motor casing 12, 12', and a plurality of independent vanes 14 mounted on the rotor so as to be radially displaceable so as to fill the variable spacing between the rotor and the casing wall. According to the teachings of the present invention, resilient seals 24 are provided between the vanes and the motor casing. Preferably, the rotor assembly further includes at least one resilient vane-slot seal 26 deployed to form a sliding seal between each of vanes 14 and facing surfaces of corresponding vane-receiving slots 28 in the rotor. A preferred implementation of vane-slot seal 26 as a sealing strip extending along both faces of vane 14 is illustrated in FIG. 3D. Vanes 14 are preferably also provided with upper and lower seal elements 30 extending along the axial ends (upper and lower edges) of the vane substantially radially relative to the axis of rotation. These upper and lower seal elements 30 may advantageously be implemented contiguously as an extension of seals 24 around the ends of the vane.

In a basic implementation, each seal 24, 26, 30 may be implemented as a sealing bead or strip deployed within a corresponding slot formed in the rotor or barrier element. Various non-limiting examples of bead and slot structures, and alternative seal structures, will be discussed below with reference to FIGS. 7-11.

FIGS. 4A-4D show a first variant of the vane motor of FIGS. 3A-3D in which additional sealing elements 32 form a rotor seal arrangement substantially circumscribing the axis of rotation and deployed for sealing between ends of the rotor and upper and lower surfaces of the chamber. This rotor seal arrangement further enhances sealing of the motor against leakage.

Figure 5A:
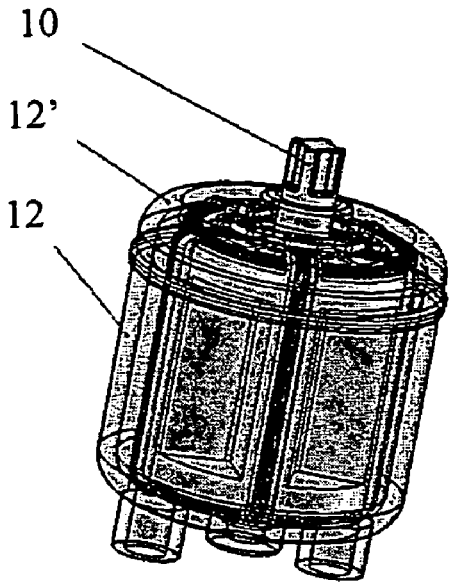
FIG. 5A is a partially transparent isometric view of a second variant implementation of a vane motor, constructed and operative according to the teachings of the present invention.
Figure 5B:
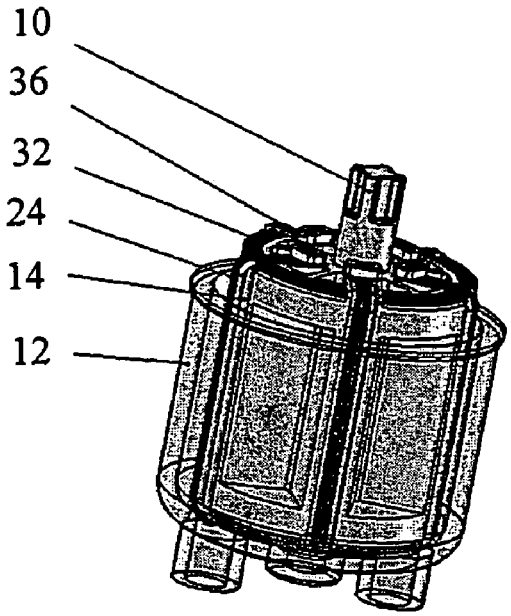
FIG. 5B is an isometric view of the vane motor of FIG. 5A with a cover portion of a casing removed.
Figure 5C:
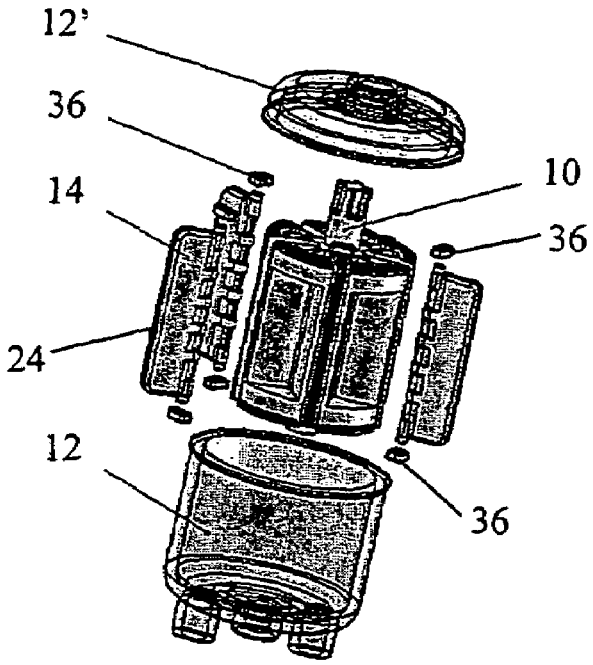
FIG. 5C is an exploded isometric view of the vane motor of FIG. 5A.
Figure 5D:
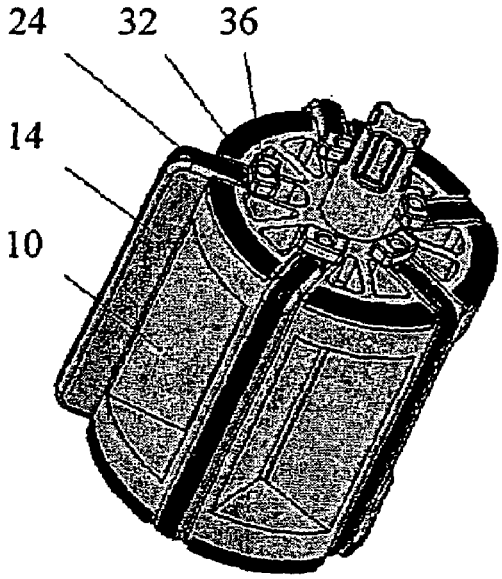
FIG. 5D is an isometric view of a rotor assembly from the vane motor of FIG. 5A.
Figure 5E:
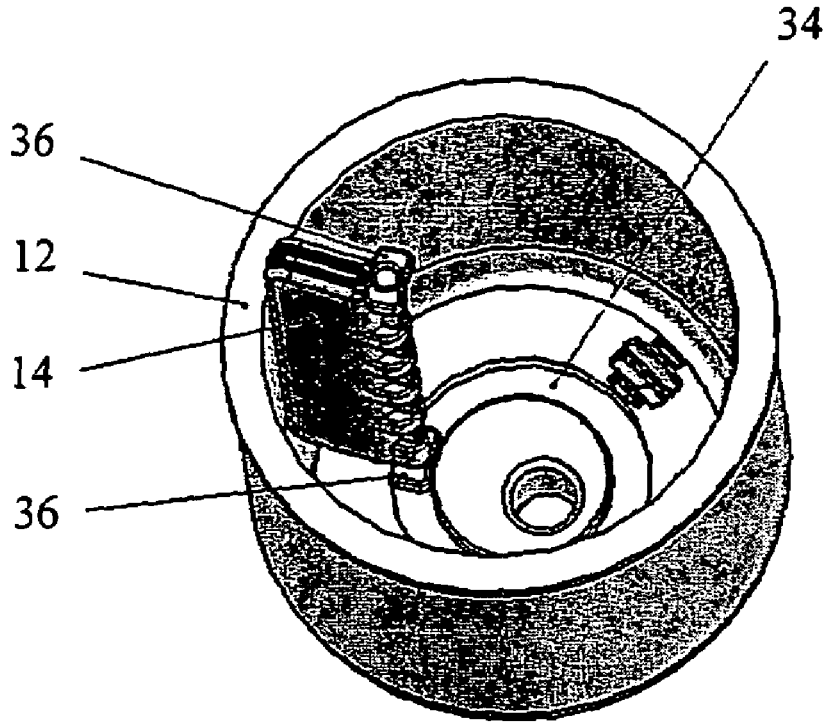
FIG. 5E is a schematic isometric view showing the engagement of a single vane within a guide channel formed in a casing of the vane motor of FIG. 5A.
Figure 6A:
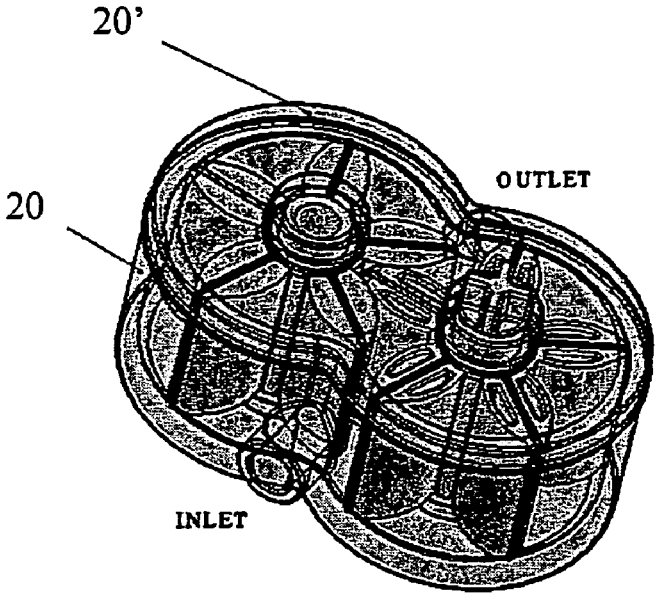
FIG. 6A is a partially transparent isometric view of a gear motor, constructed and operative according to the teachings of the present invention.
Figure 6B:
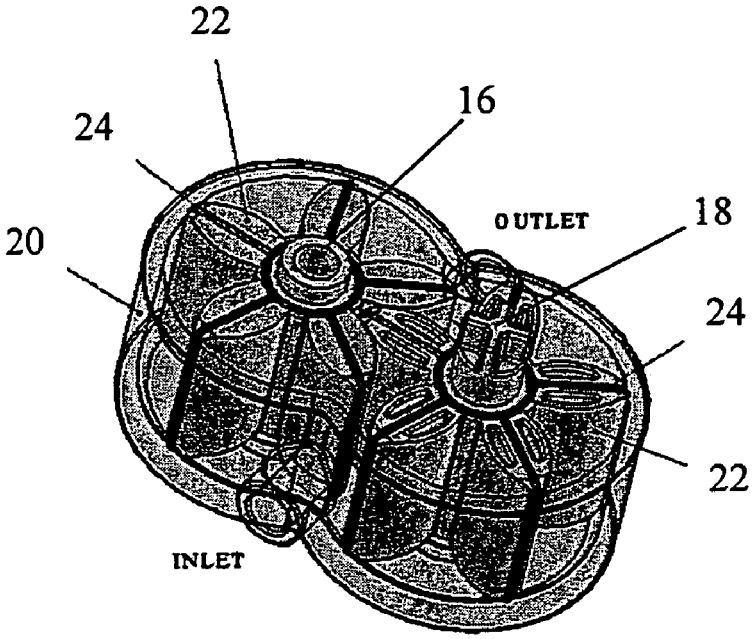
FIG. 6B is an isometric view of the gear motor of FIG. 6A with a cover portion of a casing removed.
Figure 6C:
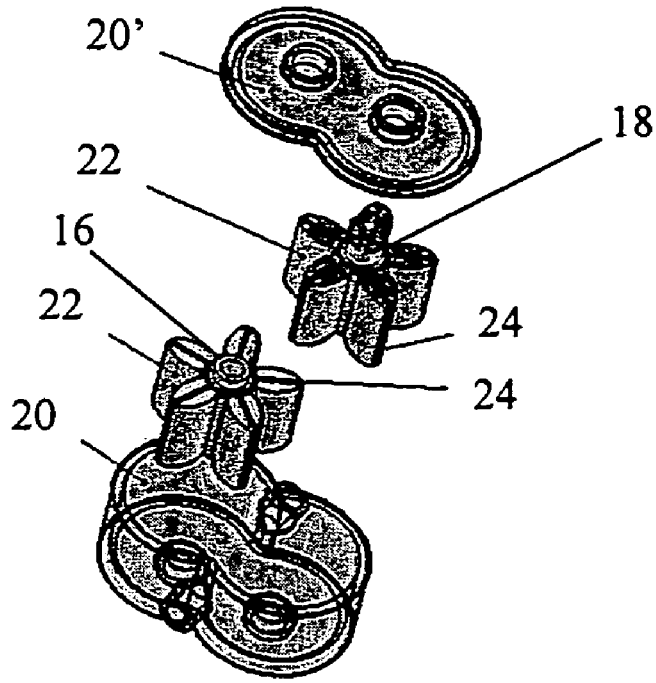
FIG. 6C is an exploded isometric view of the gear motor of FIG. 6A.
Figure 6D:
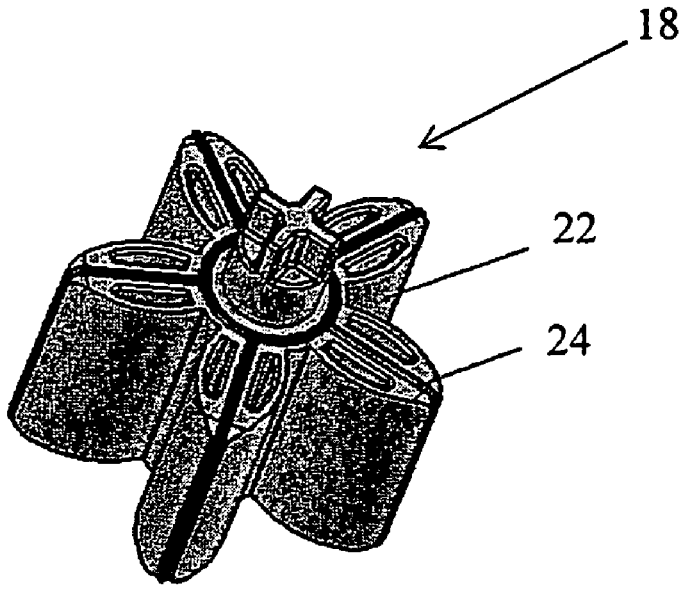
FIG. 6D is an isometric view of a rotor assembly (in this case, a gear) from the gear motor of FIG. 6A.

FIGS. 5A-5E show a second variant of the vane motor of FIGS. 3A-3D in which the radial path of the vanes is guided by a track arrangement. Specifically, as best seen in FIG. 5E, casing 12, 12' is formed with a guide track (typically either a channel or a ridge) and each vane 14 is provided with track-engaging features for engagement with the guide track. The deployment of the guide track within the casing is arranged so as to maintain a predefined spacing between each of the vanes and the facing wall of the housing during rotation of the rotor assembly. In the particularly preferred implementation illustrated here, the guide track is implemented as a channel 34 formed in at least one, and preferably both, axial end walls of casing 12, 12', and the track-engaging features are implemented as a slider block 36 projecting axially from each of vanes 14 for sliding engagement within each guide channel 34. Each slider block is preferably made from low-friction abrasion-resistant plastic rotatably mounted on a pin projecting axially from the vane. This provides optimal mechanical properties while allowing the main body of the vane to be made from low cost plastics without special properties. By maintaining a predetermined clearance between the main body of each vane and the wall of the motor casing, the track arrangement ensures that seals 24 function within a predetermined range of clearance and without excessive contact pressure.

Turning now to FIGS. 6A-6D, these illustrate a second embodiment of the present invention in the form of a gear motor in which two meshed gear wheels rotate within a motor casing. Seals between the meshed gear teeth are typically achieved in the conventional manner by direct contact between surfaces of the teeth as they turn in engagement whereas seals between the extremities of the gear teeth and the surrounding casing, as well as at the axial extremities of the gear wheels, are preferably provided according to the teachings of the present invention by resilient sealing elements.

Although the underlying structure of the gear motor embodiment is clearly distinct from the vane motor embodiment described above, the particular features of the sealing arrangements taught by the present invention are, for the most part, similar or closely analogous. Thus, here too, the device includes resilient seals 24, and preferably also upper and lower seal elements 30 extending substantially radially, and a rotor seal arrangement 32 in this case completely encircling the axis of rotation. (Clearly, there is no parallel to the vane-slot seals of the previous embodiment since the barrier elements are in this case gear teeth 22 which are typically integrally formed with the rotor.) Unless explicitly specified otherwise, it should be appreciated that all of the options addressed below with regard to the specific implementations of the various seals are equally applicable both to the vane motor and gear motor embodiments.

Figure 7:
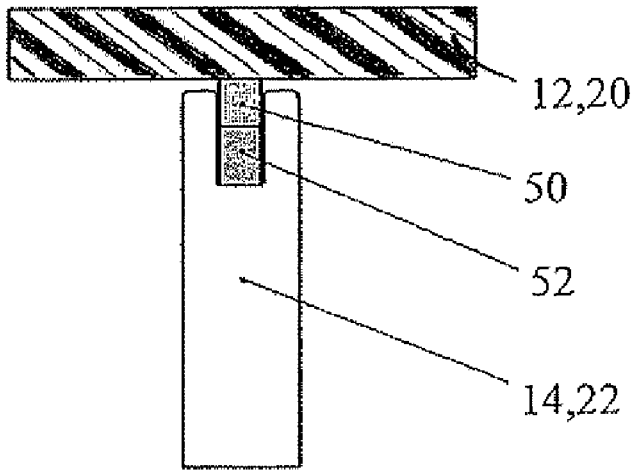
FIGS. 7-11 are schematic transverse cross-sectional views illustrating various preferred implementations of a resilient seal constructed and operative according to the teachings of the present invention, for use in the rotary motors of FIGS. 3A-6D.

Turning now to FIGS. 7-11, these illustrate various preferred options for implementing the resilient sealing elements of the present invention. As mentioned earlier, the sealing elements may be formed from elastomeric materials or from relatively rigid materials such as various types of plastics, or from any combination of such materials. Thus, in one group of implementations, the resilient seal includes a substantially rigid contact element 50 deployed so as to contact the facing wall of the housing during operation of the motor. In this context, the phrase "substantially rigid" is used to refer to any contact element which does not undergo significant deformation during normal operation of the motor. The substantially rigid contact element is resiliently mounted relative to the corresponding one of the barrier elements. The resilient mounting of the contact element may be achieved by mounting the contact element via elastomeric material 52 which functions as a spring deployed so as to bias the contact element towards the facing wall of the casing, as illustrated in FIG. 7. Alternatively, other types of spring elements may be used.

Figure 11:
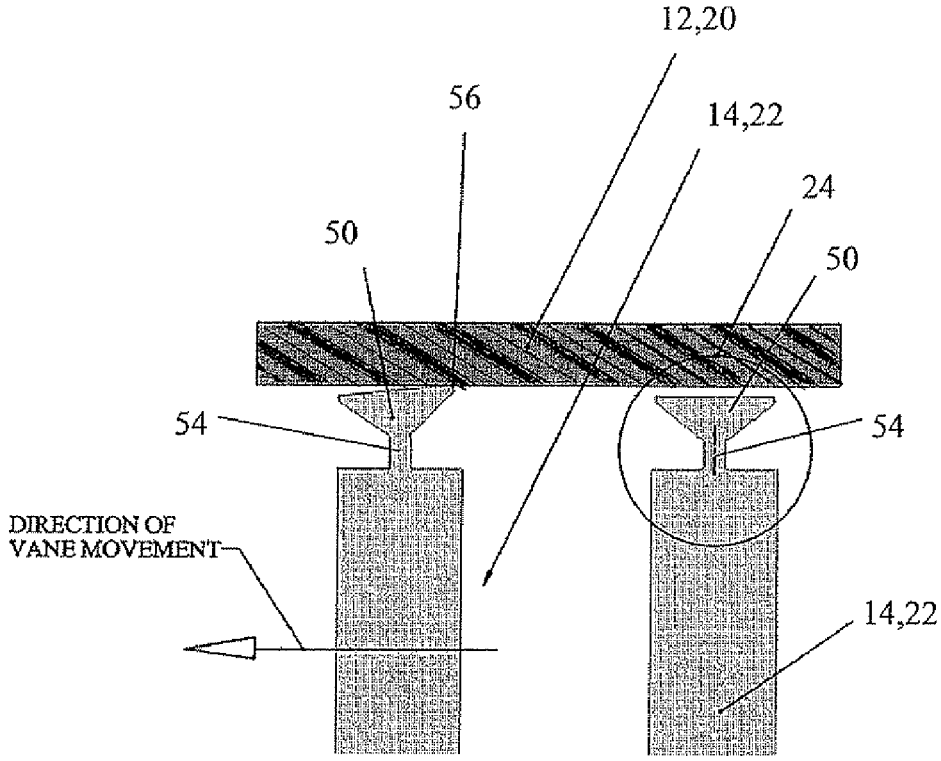

In a further example of a seal employing a substantially rigid contact element, FIG. 11 shows a case where the contact element 50 is integrally formed with the barrier element (vane 14 or gear tooth 22), and is interconnected therewith through an integral hinge 54. In this case, the resilient properties of the seal are achieved through flexing of integral hinge 54. By suitable choice of the contact element geometry as exemplified here (primarily, that the width of contact element 50 is significantly greater than the clearance spacing between the contact element and the wall of the casing), a pressure-responsive sealing configuration is achieved whereby a pressure differential applied between the two sides of the barrier element causes flexing of the hinge and hence brings a sealing edge 56 of the contact element into contact with the casing wall, as shown on the left side of FIG. 11. In the absence of a pressure difference across the barrier element, the integral hinge returns contact element 50 to its center position as shown on the right side of the figure, slightly spaced from the casing wall. Here again, the resilient properties of this structure allow the seal to accommodate significant manufacturing tolerances.

Both the cases of FIGS. 7 and 11 provide sufficient resilience to accommodate a range of manufacturing tolerances in the assembly while ensuring that the actual sealing contact surfaces are provided by relatively low-friction and hard-wearing plastic surfaces. These options are therefore believed to be of particular advantage for their wear resistance and reliability.

Alternative preferred implementations of the seals of the present invention employ an elastomeric seal element deployed so as to directly contact the facing wall of the housing during operation of the motor. Examples of such implementations are illustrated herein in FIGS. 8-10. A particularly simple and effective structure for mounting such elastomeric seal elements on the barrier elements has the elastomeric seal elements at least partially deployed within a corresponding outward facing slot formed in the barrier element.

Figure 8:
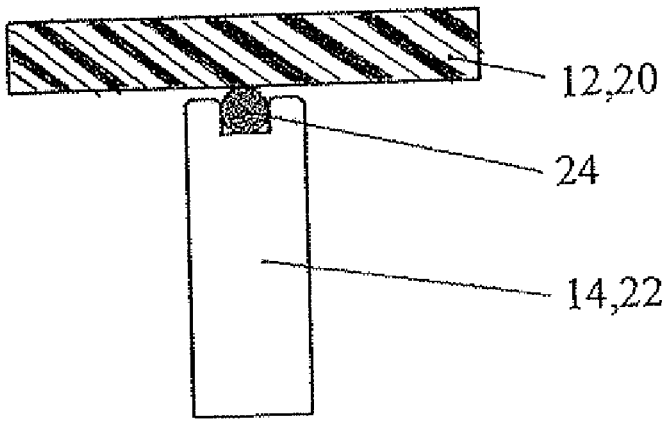
Figure 9:
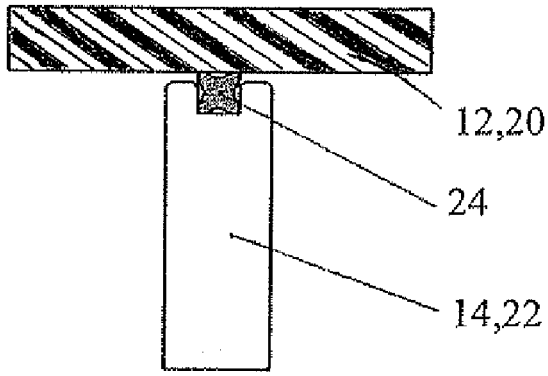

It will be noted that the elastomeric seal elements may also be implemented with various different cross-sectional shapes (compare FIGS. 8 and 9) according to the typical operating conditions for which they are intended. The geometrical forms of the sealing elements are preferably chosen to keep surface friction effects to a minimum, both in the high-pressure inlet region and in the low-pressure outlet region. In the example of FIG. 8, the elastomeric seal element is formed with a substantially circular cross-sectional shape. In the example of FIG. 9, the elastomeric seal element is formed with a pair of diverging blades for sliding against the facing wall of the casing. The diverging blades may optionally be implemented as shown as part of a unitary seal element of X-shaped cross-section. This diverging blade configuration provides bi-directional pressure-responsive sealing.

Figure 10:
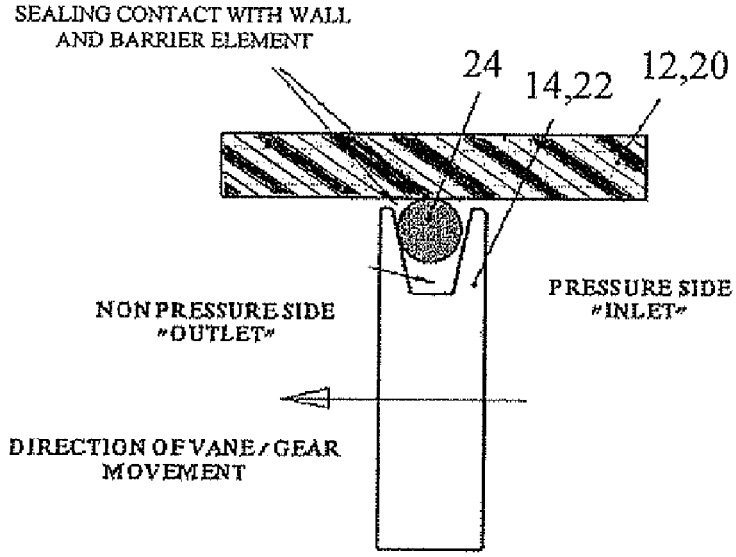

A further option for implementing the seals of the present invention is illustrated schematically in FIG. 10. Here, in contrast to the seal of FIG. 8 which is initially compressed between the two facing surfaces, the sealing bead is in this case configured be loose fitting within its slot, and is not significantly pressed against the casing wall. The slot housing the seal element is formed with outwardly sloped facing surfaces so as to form a pressure-responsive seal configuration wherein a pressure differential between the two sides of the barrier element urge the sealing element towards the interface between the outwardly sloped slot surfaces and the casing wall, thereby inducing effective contact sealing between the barrier element and the casing wall. Here again, at least for vane motor implementations, the configuration is preferably symmetrical in order to produce bi-directional pressure-responsive sealing (necessary as the vane approaches the fluid inlet). For the gear motor embodiment, unidirectional sealing may be sufficient since the seal on the side approaching the inlet is formed primarily by surface contact between the gear teeth.

Figure 12:
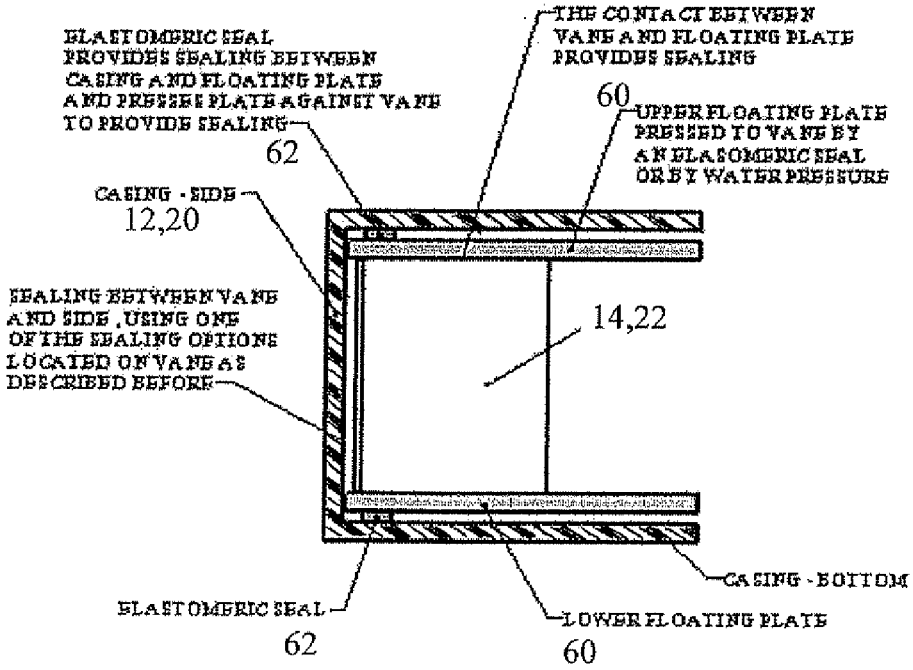
FIG. 12 is a schematic axial cross-sectional view illustrating an alternative preferred implementation for axial sealing of the rotary motors of FIGS. 3A-6D.

Turning finally to FIG. 12, this illustrates an alternative preferred option for achieving sealing of the axial ends of the rotor assemblies. In this case, a floating seal plate 60 overlies an end of the rotor assembly and is biased against the rotor assembly by at least one biasing arrangement such that the floating seal plate seals against the rotor assembly. The biasing of floating seal plate 60 against the rotor assembly may be achieved by resilient elements such as one or more elastomeric O-ring 62 deployed between the plate and the casing wall, or may be provided partially or entirely by routing of input supply fluid pressure to the outer face of the floating seal plate.

As mentioned earlier, the resilient seals of the present invention render it feasible to employ components produced to a level of precision which can readily be achieved with standard mass-production techniques such as injection molding of plastics. Accordingly, in most preferred implementations, the casing, and typically also the substantially rigid components of the rotor assemblies, are formed primarily from plastic material.

In order to facilitate operation of the motors of the present invention by attachment to a domestic water supply, preferred implementations include a connector configuration associated with the fluid inlet of the motor and adapted for interconnection with a standard domestic water supply connector. Similarly, air-pressure-driven implementations preferably feature a connector configuration with a standard air-line connector.

It should be noted that the rotary motors of the present invention are particularly suited to domestic/household applications of all types, especially where significant power output is required at low flow rates and/or low rates of revolution. Preferred applications include, but are not limited to, water driven hose reels, water driven toys, water driven fans and water driven rotating brushes, and corresponding compressed-air-driven devices.

It will be appreciated that the above descriptions are intended only to serve as examples, and that many other embodiments are possible within the scope of the present invention as defined in the appended claims.

What is claimed is:

1. A static-fluid-pressure-driven rotary motor for converting fluid pressure at art inlet into a mechanical rotary output the motor comprising:

(a) a casing defining a chamber having a fluid inlet and a fluid outlet; and (b) at least one rotor assembly rotatably mounted within said casing, said rotor assembly including:

(i) a rotor mounted so as to be rotatable about an axis of rotation;

(ii) a plurality of barrier elements associated with, and extending outwards from, said rotor, each of said barrier elements having an outer edge configured for passing in proximity to a facing wall of said casing chamber; and (iii) a resilient seal associated with at least said outer edge of each of said barrier elements, said resilient seal being configured to form a sliding seal between said outer edge and said facing wall while accommodating variations in clearance between said outer edge and said facing wall, wherein each of said barrier elements has upper and lower edges, and wherein said rotor assembly further includes upper and lower seal elements associated with said upper and lower edges and forming a sliding seal between said barrier elements and upper and lower surfaces, respectively, of said chamber.

2. The motor of claim 1 implemented as a gear motor, wherein said at least one rotor assembly is implemented as a pair of said rotor assemblies, and wherein said barrier elements are implemented as gear teeth, said pair of rotor assemblies being mounted with said axes of rotation parallel such that said gear teeth intermesh.

3. The motor of claim 1 implemented as a vane motor, wherein said at least one rotor assembly is mounted with said axis of rotation eccentrically located with respect to said casing, and wherein each of said barrier elements is implemented as a vane radially displaceable relative to said axis of rotation.

4. The motor of claim 3, wherein said casing is formed with a guide track and wherein each of said vanes is provided with track-engaging features for engagement with said guide track, said guide track being deployed so as to maintain a predefined spacing between each of said vanes and said facing wall of said housing during rotation of said rotor assembly.

5. The motor of claim 4, wherein said guide track is implemented as a channel formed in an axial end wall of said casing, and wherein said track-engaging features are implemented as a slider block projecting axially from each of said vanes for sliding engagement within said guide channel.

6. The motor of claim 1, wherein said resilient seal includes an elastomeric seal element deployed so as to contact said facing wall of said housing during operation of the motor.

7. The motor of claim 6, wherein said outer edge of each of said barrier elements includes an outward facing slot and wherein each of said elastomeric seal elements is deployed at least partially within a corresponding one of said outward facing slots.

8. The motor of claim 6, wherein said elastomeric seal element is formed with a substantially circular cross-sectional shape.

9. The motor of claim 6, wherein said elastomeric seal element is formed with a pair of diverging tapered blades for sliding against said facing wall of said casing.

10. The motor of claim 1, wherein said resilient seal is a pressure-responsive seal configured such that a fluid pressure differential applied between opposite sides of said barrier enhances a sealing effect of said seal.

11. The motor of claim 1, wherein said resilient seal includes a substantially rigid contact element deployed so as to contact said facing wall of said housing during operation of the motor, said substantially rigid contact element being resiliently mounted relative to the corresponding one of said barrier elements.

12. The motor of claim 11, wherein said contact element is supported by a spring deployed so as to bias said contact element towards said facing wall of said casing.

13. The motor of claim 11, wherein said contact element is supported by elastomeric material deployed so as to bias said contact element towards said facing wall of said casing.

14. The motor of claim 11, wherein said contact element is integrally formed with said barrier element, said contact element being interconnected with said barrier element through an integral hinge.

15. The motor of claim 1, wherein said upper and lower seal elements are contiguous with said resilient seals.

16. The motor of claim 1, wherein said upper and lower seal elements extend substantially radially relative to said axis of rotation.

17. The motor of claim 1, further comprising a floating seal plate overlying an end of said rotor assembly and biased against said rotor assembly by at least one biasing arrangement such that said floating seal plate seals against said rotor assembly.

18. The motor of claim 1, further comprising a connector configuration associated with the fluid inlet of the motor and adapted for interconnection with a standard domestic water supply connector.

19. The motor of claim 1, wherein said casing is formed primarily from plastic material.

20. A static-fluid-pressure-driven rotary vane motor for converting fluid pressure at an inlet into a mechanical rotary output, the vane motor comprising:

(a) a casing defining a chamber having a fluid inlet and a fluid outlet; and (b) at least one rotor assembly rotatable mounted within said casing, said rotor assembly including:

(i) a rotor mounted so as to be rotatable about an axis of rotation;

(ii) a plurality of barrier elements associated with, and extending outwards from, said rotor, each of said barrier elements having an outer edge configured for passing in proximity to a facing wall of said casing chamber; and (iii) a resilient seal associated with at least said outer edge of each of said barrier elements, said resilient seal being configured to form a sliding seal between said outer edge and said facing wall while accommodating variations in clearance between said outer edge and said facing wall, wherein said at least one rotor assembly is mounted with said axis of rotation eccentrically located with respect to said casing, and wherein each of said barrier elements is implemented as a vane radially displaceable relative to said axis of rotation, and wherein said vanes are radially displaceable within slots formed in said rotor, the rotor assembly further including at least one resilient vane-slot seal deployed to form a sliding seal between each of said vanes and facing surfaces of a corresponding one of said slots.

21. A static-fluid-pressure-driven rotary vane motor for converting fluid pressure at an inlet into a mechanical rotary output, the vane motor comprising:

(a) a casing defining a chamber having a fluid inlet and a fluid outlet; and (b) at least one rotor assembly rotatably mounted within said casing, said rotor assembly including:

(i) a rotor mounted so as to be rotatable about an axis of rotation;

(ii) a plurality of barrier elements associated with and extending outwards from, said rotor, each of said barrier elements having an outer edge configured for passing in proximity to a facing wall of said casing chamber; and (iii) a resilient seal associated with at least said outer edge of each of said barrier elements, said resilient seal being configured to form a sliding seal between said outer edge and said facing wall while accommodating variations in clearance between said outer edge and said facing wall, wherein said rotor assembly further includes a rotor seal arrangement substantially circumscribing said axis of rotation and deployed for sealing between ends of said rotor and upper and lower surfaces of said chamber.

* * * * *